US009080324B2

(12) United States Patent
Eriksson

(10) Patent No.: US 9,080,324 B2
(45) Date of Patent: Jul. 14, 2015

(54) BIODEGRADABLE SHOWER WEEP HOLE GASKET

(75) Inventor: Leonard Eriksson, Oxnard, CA (US)

(73) Assignee: Innovative Leak Solutions, Inc., Oxnard, CA (US)

( * ) Notice: Subject to any disclaimer, the term of this patent is extended or adjusted under 35 U.S.C. 154(b) by 413 days.

(21) Appl. No.: 13/539,313

(22) Filed: Jun. 30, 2012

(65) Prior Publication Data

US 2012/0273057 A1 Nov. 1, 2012

Related U.S. Application Data

(63) Continuation-in-part of application No. 12/401,544, filed on Mar. 10, 2009, now abandoned.

(51) Int. Cl.
*E03D 11/17* (2006.01)
*E03F 5/04* (2006.01)

(52) U.S. Cl.
CPC ..... *E03F 5/041* (2013.01); *E03F 5/0409* (2013.01)

(58) Field of Classification Search
CPC ..... E03F 5/0411; E03F 5/041; E03F 5/0408; E03F 5/0409
USPC ..... 210/165; 4/679, 613, 252.6
See application file for complete search history.

(56) References Cited

U.S. PATENT DOCUMENTS

| | | | | |
|---|---|---|---|---|
| 2,394,964 | A * | 2/1946 | Dick | 210/165 |
| 2,743,786 | A * | 5/1956 | Boosey | 210/165 |
| 5,216,757 | A * | 6/1993 | Dorkin | 2/152.1 |
| 8,813,273 | B2 * | 8/2014 | Stimpson | 4/288 |

* cited by examiner

*Primary Examiner* — Janie Christiansen
(74) *Attorney, Agent, or Firm* — Risso & Associates

(57) ABSTRACT

A ring-shaped biodegradable shower drain weep holes gasket is disclosed that slips over the top of the shower drain. The gasket fits tightly over the top of the drain to solve the problem of material clogging the shower drain weep holes and additionally preventing any deck mud or debris from entering and clogging the weep holes during installation. Approximately $\frac{7}{8}^{ths}$ inch high by $\frac{5}{2}^{ths}$ inch wide at an inner diameter of $\frac{31}{5}^{ths}$ inch, the biodegradable shower gasket then surrounds the shower drain's top flange and weep holes. Over a short period of time, the moisture in the cement along with any moisture that seeps through the tile or grout will dissolve the biodegradable gasket creating a permanent opening for water to drain out through the weep holes.

7 Claims, 3 Drawing Sheets

BIODEGRADABLE SHOWER WEEP HOLE GASKET

CROSS-REFERENCE TO RELATED APPLICATION

This application is a continuation in part of non-provisional patent application Ser. No. 12/401,544 filed on Mar. 10, 2009 now abandoned, which is currently pending. The prior application is incorporated herein by reference.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention generally relates to methods of installing shower drains. Installation methods known in the art have a tendency of clogging the shower drain's weep holes and inhibit their functionality.

Servicing clogged shower weep holes is a complicated process wherein the method of reaching the weep holes depends on individual plumbers. In any event no method currently exists for unclogging weep holes without considerable effort. Therefore, preventing materials from clogging the shower drain weep holes altogether remains unaddressed.

It is therefore the object of the present invention to address the problem of preventing materials from clogging the shower drain weep holes by plugging the holes with a dissolving porous gasket during shower drain floor installation so that the gasket decomposes by action of moisture seeping through the adjacent floor covering once the drain is in use.

SUMMARY

The present invention comprises a method of preventing material from clogging shower drain weep holes. A gasket for preventing material from clogging the shower drain weep holes is utilized during floor installation. The gasket is comprised of a dissolving porous ring shaped material that covers the shower drain weep holes during floor installation. In a preferred embodiment, the shower drain wall and flange surface maintain substantial uniform contact with the gasket.

The gasket is composed of biodegradable material that dissolves and seeps through the shower drain weep holes. Three-dimensionally, the material is shaped to form a concaved curve bounded by substantially perpendicular sides to encircle the shower drain. In another preferred embodiment, the gasket is approximately $\frac{7}{8}^{ths}$ inch high by $\frac{5}{2}^{ths}$ inch wide at an inner diameter of $\frac{31}{5}^{ths}$ inch, wherein the gasket comprises nipples disposed angularly between the bottom surface and the inner surface of the gasket for plugging the shower drain weep holes.

Biodegradable materials are utilized, chosen from any biodegradable material characterized by dissolvability, to comprise a shower drain weep hole gasket wherein the gasket is resilient to moisture introduced as material is floated during floor installation. The biodegradable gasket eventually disintegrates due to the introduction of moisture coming through the adjacent floor covering once the drain is in use, upon which the disintegrated components of the gasket pass through drain weep holes.

DRAWINGS

DESCRIPTION

Figure 1:
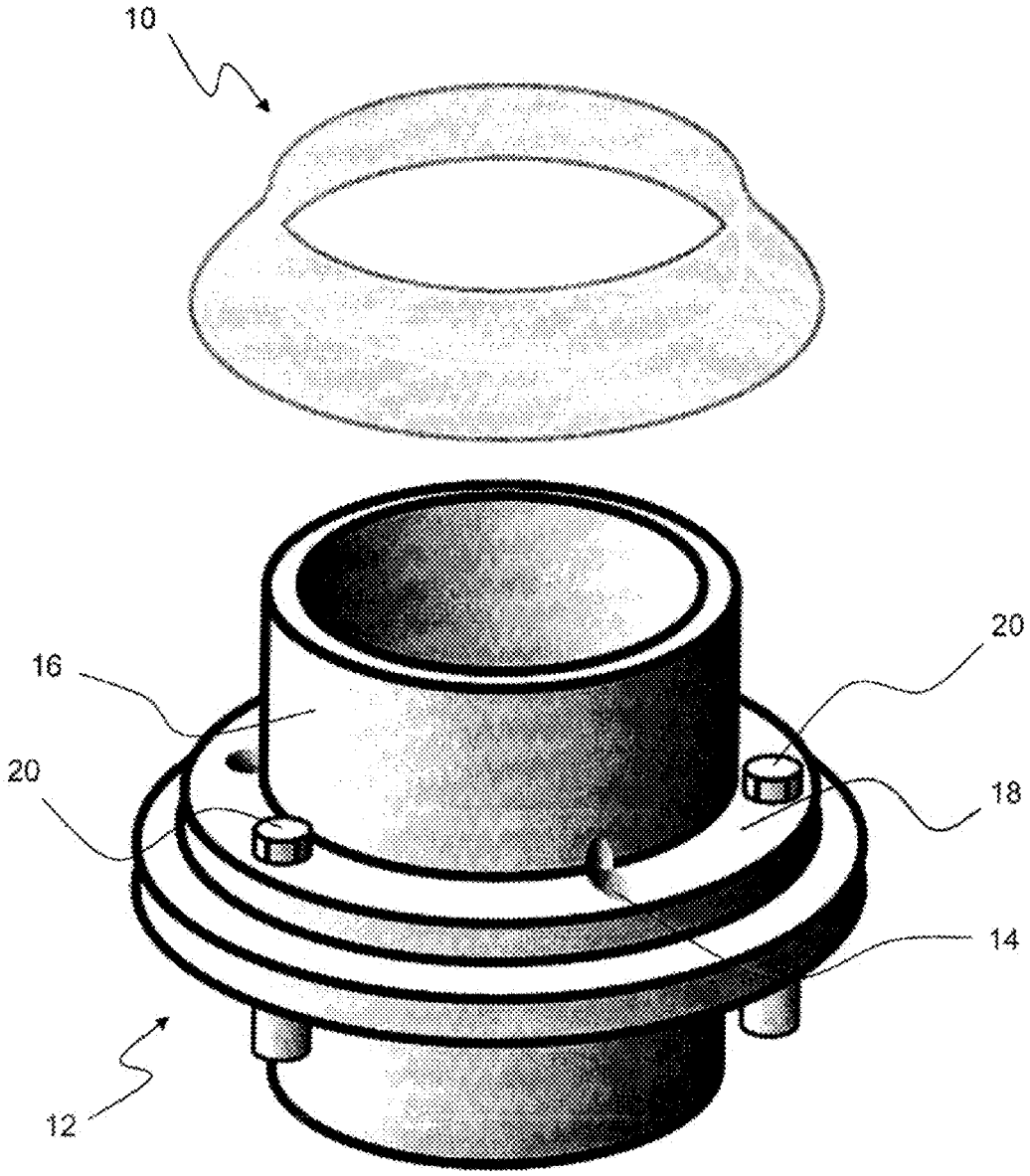
FIG. 1 is a perspective view of a shower drain and uninstalled biodegradable shower drain weep holes gasket.

Referring to FIG. 1 a gasket is shown and described prior to installation. The gasket 10 prevents material from clogging the weep holes 14 of a shower drain 12 wherein the gasket 10 comprises a dissolving porous ring-shaped material that plugs the shower drain 12 weep holes 14 during floor installation. In a preferred embodiment, the shower drain 12 outer wall 16 and flange surface 18 maintain substantial uniform contact with the gasket 10.

Still referring to FIG. 1, the gasket 10 is composed of a biodegradable material, which will dissolve and seep through the shower drain 12 weep holes 14. This gasket has a concaved curve bounded by substantially perpendicular sides to encircle the shower drain 12. In yet another preferred embodiment, the gasket 10 is approximately $\frac{7}{8}^{ths}$ inch high by $\frac{5}{2}^{ths}$ inch wide at an inner diameter of $\frac{31}{5}^{ths}$ inch, wherein notches (shown in FIG. 2) are disposed on the bottom surface to accommodate fixed drain bolts 20.

Figure 2:
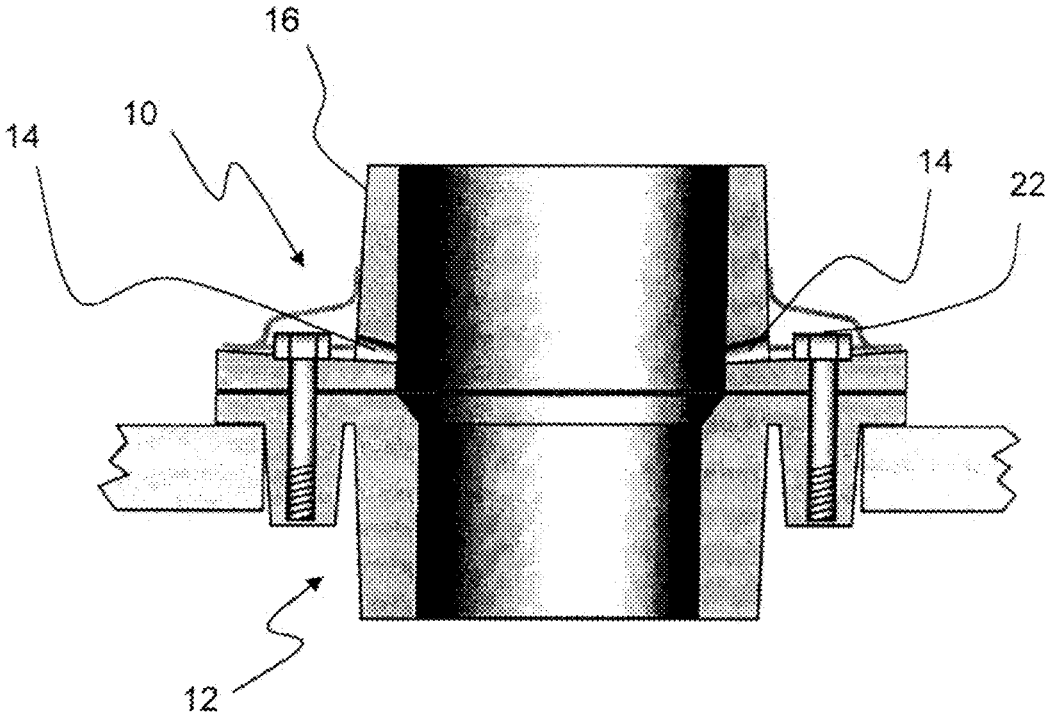
FIG. 2 is a perspective view of a shower drain installed with a biodegradable shower drain weep holes gasket.

Referring to FIG. 2, the gasket 10 is shown installed on a shower drain 12 in a uniform contacting manner with the shower drain 12 outer wall 16 and flange surface to prevent weep hole 14 clogging. The gasket 10 comprises notches 22 disposed on the bottom surface of the gasket to accommodate fixed drain bolts.

Figure 3:
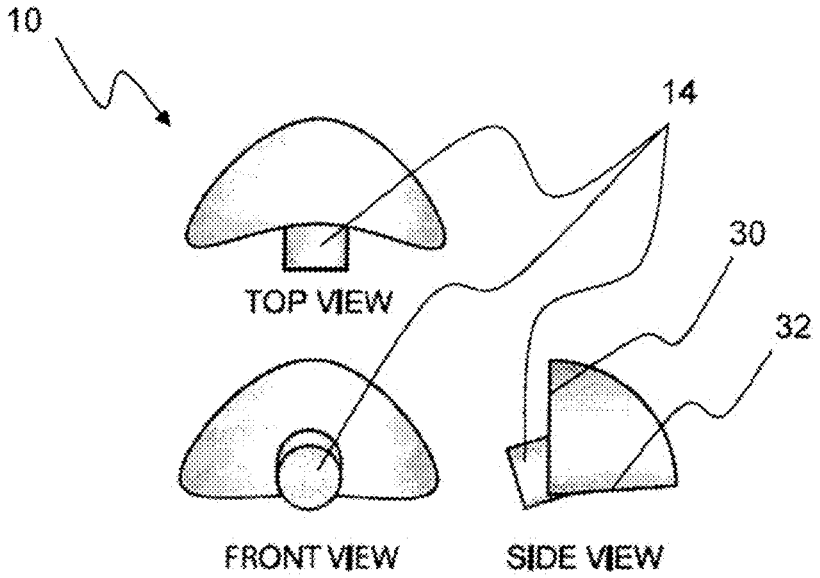
FIG. 3 shows multiple nipple section views of the biodegradable shower drain weep holes gasket.

Referring to FIG. 3, multiple section views of the gasket 10 are shown in a preferred embodiment composed of a biodegradable material, chosen from any biodegradable material characterized by dissolvability. For example, biodegradable products may include corn starch, sugar, salt, biodegradable paper and/or cardboard and others available. During floor installation the gasket 10 is resilient to moisture introduced as material is floated, but eventually disintegrates due to the introduction of moisture coming through the adjacent floor covering.

Still referring to the preferred embodiment of the gasket 10 shown in FIG. 3, comprises drain plugs 14 for plugging shower drain weep holes, wherein the drain plugs 14 comprise substantially cylindrical extrusions disposed angularly between the gaskets 10 bottom surface 30 and its inner radial surface 32.

Figure 4:
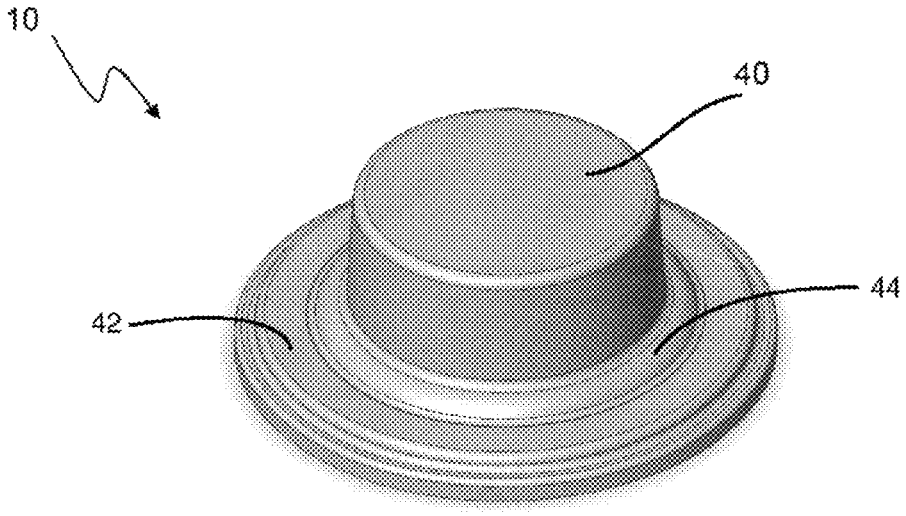
FIG. 4 is a perspective view of an uninstalled biodegradable shower drain weep holes gasket.

FIG. 4 illustrates an embodiment of the gasket 10 wherein the gasket's inner surface is in continuous contact with the shower drain 12 outer wall 16 and extends above the shower drain 12. The gasket 10 face above the shower drain 12 is enclosed to form a drain cover 40 to prevent foreign materials from entering the shower drain during construction or floor installation, and which may be removed at a later time.

Figure 5:
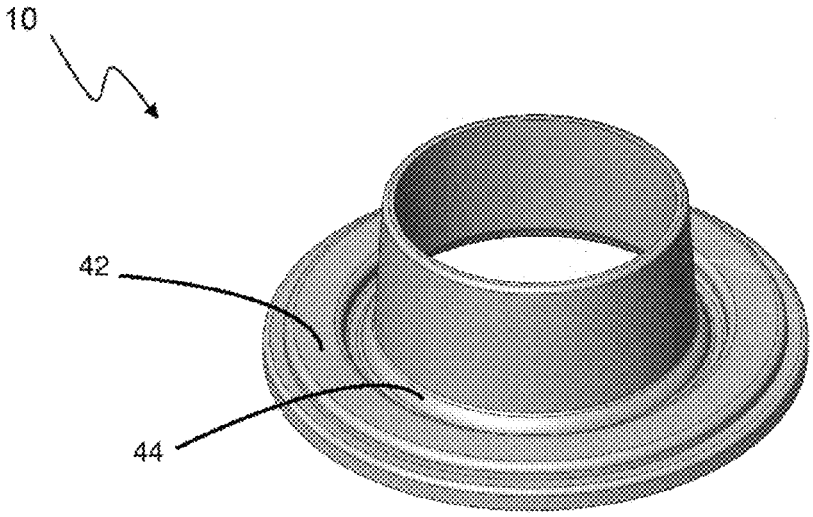
FIG. 5 is a perspective view of an uninstalled biodegradable shower drain weep holes gasket.

The preferred embodiment of the gasket 10 shown in FIG. 4-5, further comprises a channel 42, disposed on the bottom surface of the gasket between the substantially perpendicular inner and outer sides of the gasket 10. The channel 42 accommodates for varying orientations of fixed drain bolts 20 around the flange surface 18.

The preferred embodiment of the gasket 10 shown in FIG. 4-5, further comprises a weep hole cavity 44, for covering shower drain weep holes, between the gaskets 10 bottom surface 30 and its inner radial surface 32 extending around the inner circumference of the gasket 10. The weep hole cavity 44 accommodates for varying orientations of shower drain weep holes 14 around the shower drain 12. It should be noted that some shower drains weep holes are disposed on the edges of the shower drain. The preferred embodiment of the invention also serves to cover shower drain weep holes disposed on the edges of shower drains.

FIG. 5 illustrates an alternate embodiment of the gasket 10 shown in FIG. 4 wherein the drain cover 40 is absent.

All features disclosed in this specification, including any accompanying claim, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A method of preventing material from clogging shower drain weep holes of a shower drain, comprising covering the holes with a dissolving porous gasket during floor installation, wherein the gasket is preformed such that it is shaped as a ring with a continuous exterior arched surface that passes around the ring, the arched surface having a top portion and a bottom portion and bounded by a cylindrical sleeve projecting up from the top portion and a base projecting laterally from the bottom portion, such that the arch extends outwardly and downwardly from the cylindrical sleeve to the base, and such that the sleeve and base are substantially perpendicular to one another and encircle the shower drain, and wherein the gasket decomposes by action of moisture seeping through an adjacent floor covering once the shower drain is in use.

2. A gasket for preventing material from clogging shower drain weep holes of a shower drain, comprising a ring-shaped gasket formed of a biodegradable material, the ring-shaped gasket having a preformed continuous exterior arched surface that passes around the ring, the arched surface having a top portion and a bottom portion and bounded by a cylindrical sleeve projecting up from the top portion and a base projecting laterally from the bottom portion, such that the arch extends outwardly and downwardly from the cylindrical sleeve to the base, and such that the sleeve and base are substantially perpendicular to one another and encircle the shower drain, and wherein the gasket decomposes by action of moisture seeping through an adjacent floor covering once a shower drain is in use.

3. The gasket of claim 2, wherein the gasket is approximately $\frac{7}{8}^{ths}$ inch high by $\frac{5}{2}^{ths}$ inch wide at an inner diameter of $3\frac{1}{5}^{ths}$ inch.

4. The gasket of claim 2, wherein the materials comprising the gasket may be chosen from any biodegradable dissolvable material.

5. The gasket of claim 2, wherein the gasket is resilient to moisture introduced as material is floated during floor installation, but eventually disintegrates due to the introduction of moisture coming through the adjacent floor covering once the drain is in use.

6. The gasket of claim 2, wherein disintegrated components of the gasket pass through drain weep holes.

7. The gasket of claim 2, wherein the gasket maintains substantial uniform contact with an outer drain wall and a flange surface.

* * * * *